United States Patent [19]

Williams

[11] Patent Number: 4,936,616

[45] Date of Patent: Jun. 26, 1990

[54] ENGINE TILTING DEVICE

[76] Inventor: William M. Williams, 92 Glutz Hade Rd., Dunlanon, Pa. 17020

[21] Appl. No.: 396,038

[22] Filed: Aug. 21, 1989

[51] Int. Cl.[5] ..... B66C 1/10; B66C 13/08

[52] U.S. Cl. ..... 294/81.3; 294/67.5

[58] Field of Search ..... 294/67.21, 67.5, 81.3, 294/81.4, 82.12, 86.41

[56] References Cited

U.S. PATENT DOCUMENTS

| | | | |
|---|---|---|---|
| 2,703,252 | 3/1955 | Blackwell | 294/86.41 X |
| 3,433,459 | 3/1969 | Logan | 294/81.3 X |
| 3,596,968 | 8/1971 | Holm | 294/81.3 |
| 3,751,097 | 8/1973 | Jones et al. | 294/81.3 |
| 4,431,223 | 2/1984 | Miller | 294/81.4 |
| 4,597,602 | 7/1986 | McGriff | 294/81.3 |
| 4,626,012 | 12/1986 | Weldele | 294/81.3 |

FOREIGN PATENT DOCUMENTS

| | | | |
|---|---|---|---|
| 1058551 | 3/1954 | France | 294/81.3 |
| 33244 | 3/1977 | Japan | 294/81.3 |

*Primary Examiner*—Johnny D. Cherry
*Attorney, Agent, or Firm*—Jerry T. Kearns

[57] ABSTRACT

An engine tilting device for use in installing and removing engines from vehicles has a base plate provided with a plurality of apertures formed in a predetermined pattern to match bolt hole patterns of a variety of standard intake manifolds. The base plate is secured on an engine intake manifold after removal of the carburetor. In a first embodiment of the invention, a lifting tab is mounted by a lead screw mechanism for reciprocal linear movement with respect to the base plate. In a second embodiment of the invention, the lifting tab is mounted for independent reciprocal linear movement in two perpendicular directions by independent lead screw mechanisms. The lifting tab may be oriented as required to allow tilting of the engine during installation and removal.

1 Claim, 4 Drawing Sheets

ENGINE TILTING DEVICE

BACKGROUND OF THE INVENTION

1. Field of the Invention

The present invention relates to engine tilting devices, and more particularly pertains to an engine tilting device to facilitate removal and installation of engines from vehicles. During engine installation and removal, it is necessary to tilt an engine to clear various engine compartment obstacles and to provide proper alignment with the vehicle transmission. In order to facilitate this tilting process, the invention provides a lifting tab secured by an adjustable mounting mechanism to a base plate adapted for securement to an engine intake manifold.

2. Description of the Prior Art

The conventional method of removing and installing engines in vehicles entails the installation of lifting bolts or hooks in various threaded apertures provided in the engine block. A chain yoke is then connected to the lifting bolts or hooks and is secured to the hook of a chain fall or hydraulic engine hoist. Tilting of the engine is then accomplished by manually pushing or pulling the engine to a desired orientation. This is a difficult and dangerous operation.

SUMMARY OF THE INVENTION

In view of the foregoing disadvantages inherent in the known types of engine tilting devices now present in the prior art, the present invention provides an improved engine tilting device. As such, the general purpose of the present invention, which will be described subsequently in greater detail, is to provide a new and improved engine tilting device which has all the advantages of the prior art engine tilting devices and none of the disadvantages.

To attain this, representative embodiments of the concepts of the present invention are illustrated in the drawings and make use of an engine tilting device for use in installing and removing engines from vehicles which has a base plate provided with a plurality of apertures formed in a predetermined pattern to match bolt hole patterns of a variety of standard intake manifolds. The base plate is secured on an engine intake manifold after removal of the carburetor. In a first embodiment of the invention, a lifting tab is mounted by a lead screw mechanism for reciprocal linear movement with respect to the base plate. In a second embodiment of the invention, the lifting tab is mounted for independent reciprocal linear movement in two perpendicular directions by independent lead screw mechanisms. The lifting tab may be oriented as required to allow tilting of the engine during installation and removal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine tilting device which has all the advantages of the prior art engine tilting devices and none of the disadvantages.

It is another object of the present invention to provide a new and improved engine tilting device which may be easily and efficiently manufactured and marketed.

It is a further object of the present invention to provide a new and improved engine tilting device which is of a durable and reliable construction.

An eve further object of the present invention is to provide a new and improved engine tilting device which is susceptible of a low cost of manufacture with regard to both materials and labor, and which accordingly is then susceptible of low prices of sale to the consuming public, thereby making such engine tilting devices economically available to the buying public.

Still yet another object of the present invention is to provide a new and improved engine tilting device which provides in the apparatuses and methods of the prior art some of the advantages thereof, while simultaneously overcoming some of the disadvantages normally associated therewith.

Still another object of the present invention is to provide a new and improved engine tilting device to facilitate installation and removal of engines from vehicles.

Yet another object of the present invention is to provide a new and improved engine tilting device which allows reciprocal linear adjustment of a mounting tab with respect to a base plate adapted for securement to an intake manifold of an engine.

Even still another object of the present invention is to provide a new and improved engine tilting device having a base plate provided with a plurality of apertures oriented in a predetermined pattern for alignment with bolt hole patterns of a variety of standard engine intake manifolds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
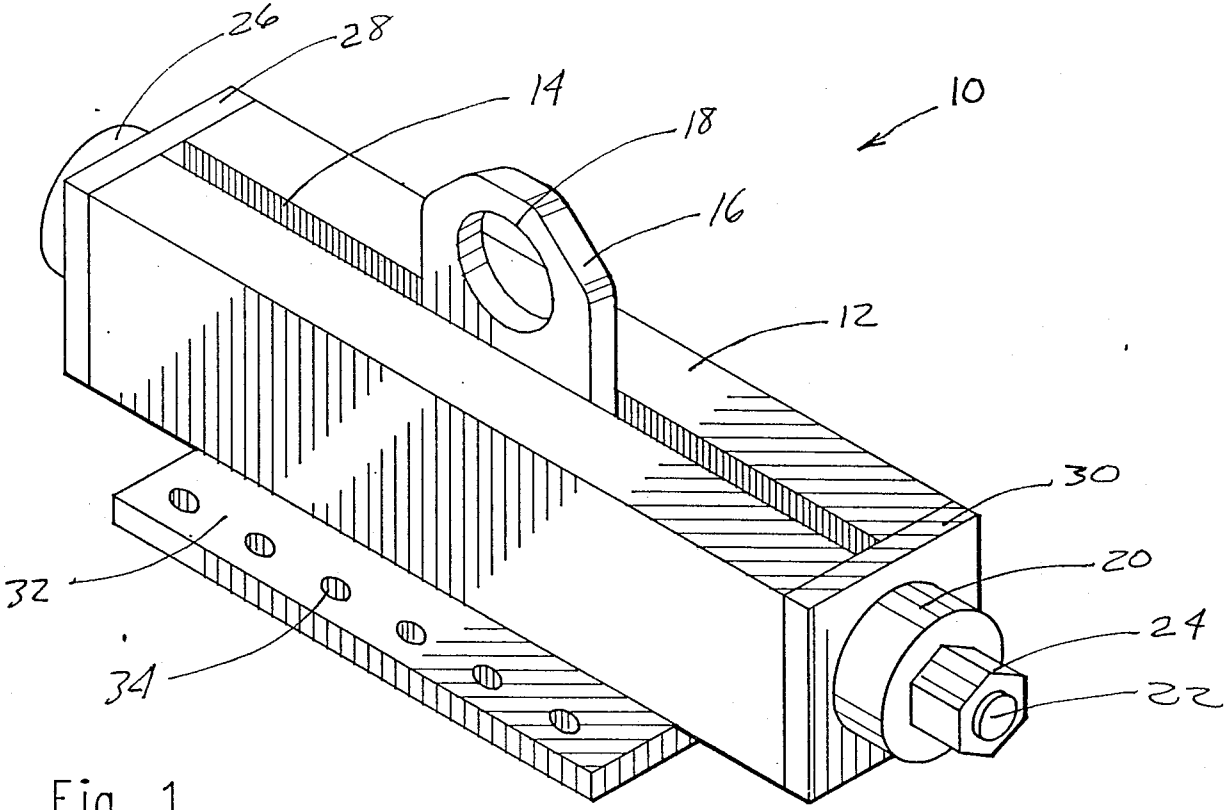
FIG. 1 is a perspective view of the engine tilting device according to a first embodiment of the present invention.

With reference now to the drawings, and in particular to FIG. 1 thereof, a new and improved engine tilting device embodying the principles and concepts of the present invention and generally designated by the reference numeral 10 will be described.

More specifically, it will be noted that the first embodiment 10 of the invention includes a base 32 formed as a thin rectangular steel plate. The base 32 is provided with a plurality of apertures 34, preferably disposed in a predetermined orientation to match the bolt hole patterns of a variety of standard engine intake manifolds. The tilting device 10 includes an elongated generally rectangular housing 12 having a top wall provided with an elongated slot 14. A lifting tab 16 is mounted through the slot 14 for reciprocal linear movement therealong. A circular aperture 18 is provided in the lifting tab 16 for engagement with the hook of a chain of an engine hoist. The lifting tab 16 may alternatively be formed as a hook, or in another suitable configuration. A pair of bearings 20 and 26 are secured on opposite end plates 30 and 28 of the housing 12 and serve to rotatably mount an elongated lead screw extending within the housing 12, parallel to the slot 14. One end 22 of the lead screw is illustrated in FIG. 1 and is provided with a hexagonal driving head 24 for engagement with a conventional socket or wrench. The driving head 24 is fixed against rotation with respect to the lead screw end 22.

Figure 2:
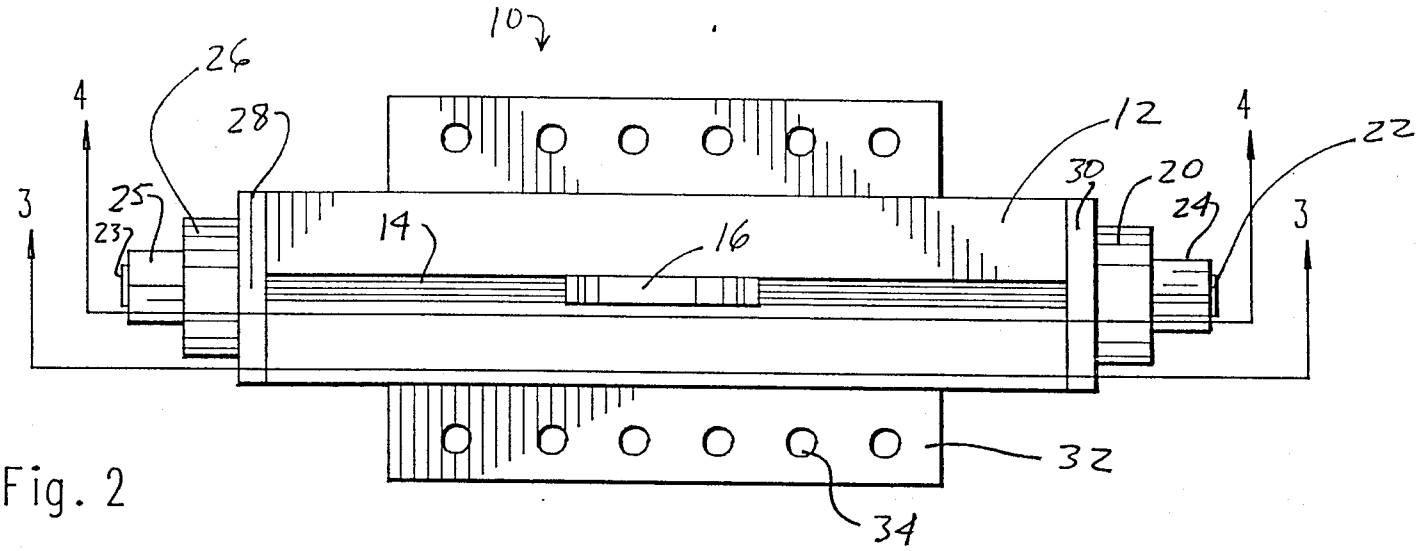
FIG. 2 is a top plan view of the engine tilting device of FIG. 1.

FIG. 2 illustrates a top plan view of the tilting device 10 of FIG. 1. An opposite end 23 of the lead screw is provided with a driving head 25.

Figure 3:
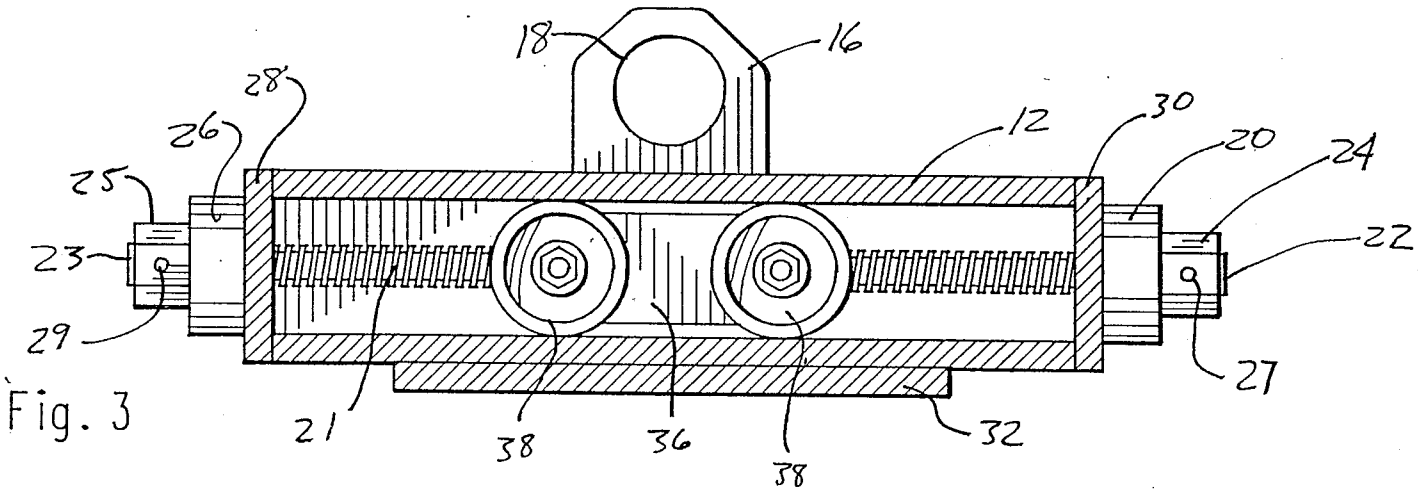
FIG. 3 is a cross sectional view, taken along line 3—3 of FIG. 2.

As shown in the cross sectional view of FIG. 3, the lead screw 21 extends within the housing 12 and supports a carriage 36. A threaded bore is formed through the carriage 36 forming a lead nut which is in threaded engagement with the lead screw 21. Thus, upon rotation of the lead screw 21 by engagement of a wrench with either of the driving heads 24 or 25, the carriage 36 is caused to move linearly within the housing 12. A plurality of roller bearings 38 support the carriage 36 within the housing 12. It should be noted that the bearings 38 afford a relatively tight mounting of the carriage 36, so as to prevent rotation of the lead screw 21 by force exerted on the carriage 36 through the lifting tab 16. The driving heads 24 and 25 may comprise threaded nuts secured at the opposite ends 22 and 23 of the lead screw 21 through the use of transversely extending roll pins 27 and 29. Alternatively, the driving heads 24 and 25 may be welded to the lead screw ends 22 and 23. The use of the roll pins 27 and 29 is preferred, because this allows disassembly of the device, when required.

Figure 4:
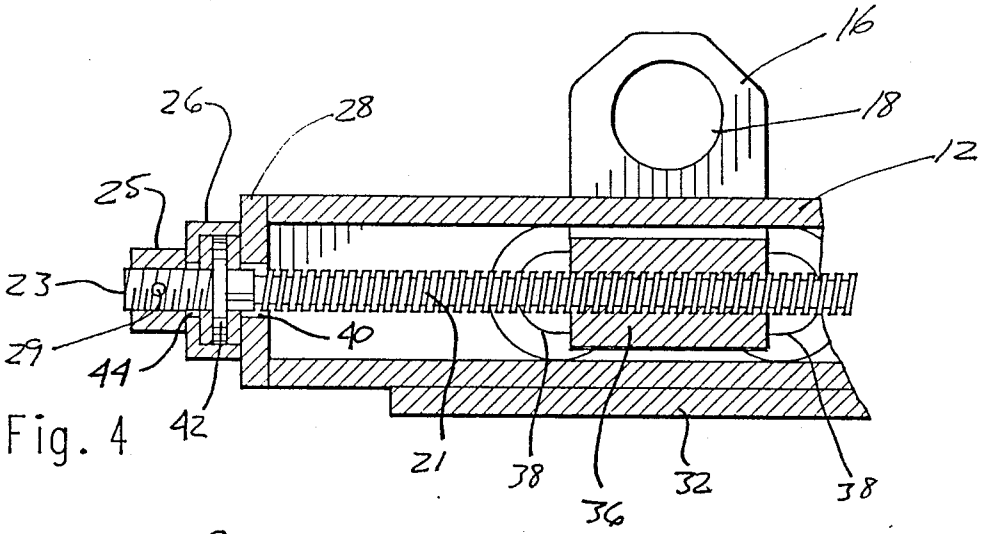
FIG. 4 is a cross sectional view, taken along line 4—4 of FIG. 2.

FIG. 4 is a partial cross sectional view which illustrates the details of the bearing 26. It should be noted that the opposite bearing 20 (FIG. 2) is similarly constructed. The bearing 26 receives an enlarged radial flange 42 secured to the lead screw 21 which prevents axial movement of the lead screw, and allows rotation of the lead screw 21 with respect to the housing 12. The lead screw passes through aligned apertures 40 and 44 formed in the end wall 28 and bearing 26, respectively.

Figure 5:
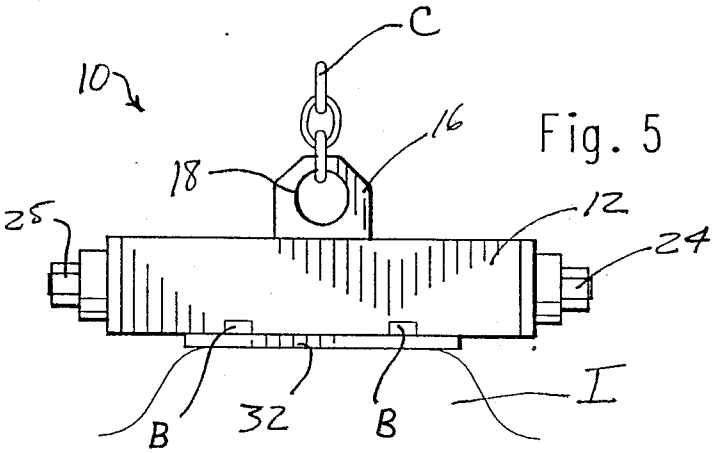
FIG. 5 is a side elevational view illustrating the engine tilting device according to the first embodiment of the invention installed on an engine intake manifold.

FIG. 5 illustrates the engine tilting device 10 installed on the intake manifold I of a conventional internal combustion engine. The mounting base plate 32 is secured in place of the carburetor by a plurality of bolts B. The bolts B are preferably of a heat treated or hardened steel material to support the substantial weight of the engine. The chain C of an engine hoisting device is secured to the lifting tab 16.

Figure 6:
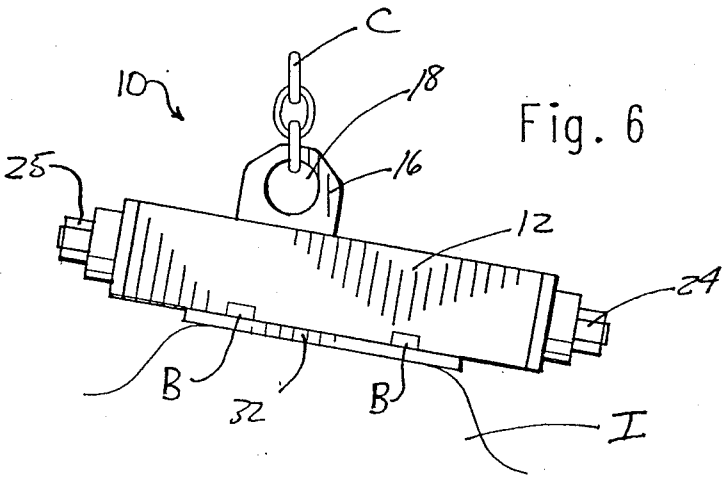
FIG. 6 illustrates the use of the engine tilting device of the first embodiment of the invention to tilt an engine during installation or removal.

As shown in FIG. 6, the lifting tab 16 may be moved along the housing 12 by rotation of either of the driving heads 24 or 25. This changes the balance point of the engine, resulting in the illustrated tilt. The provision of driving heads 24 and 25 at opposite ends of the housing 12 allows convenient access to a mechanic at either side of the engine compartment.

Figure 7:
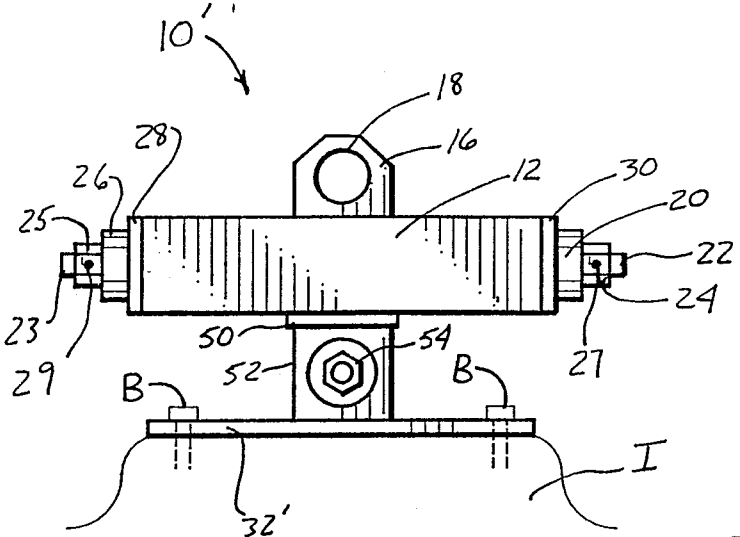
FIG. 7 is a side elevational view illustrating an engine tilting device according to a second embodiment of the invention installed on the intake manifold of an engine.

FIG. 7 is a side elevational view which illustrates a second embodiment 10′ in which the housing 12 is mounted by a mounting plate 50 for movement along a rectangular housing 52. The mounting plate 50 is mounted for linear movement by a lead screw mechanism identically constructed as illustrated in FIGS. 3 and 4 above. Thus, the mounting tab 16 is independently adjustable in two perpendicular directions by rotation of the driving heads 24 and 25, and the driving heads of the housing 52, one of which is illustrated at FIG. 4. The mounting plate 32′ is secured by bolts B to an engine intake manifold I.

Figure 8:
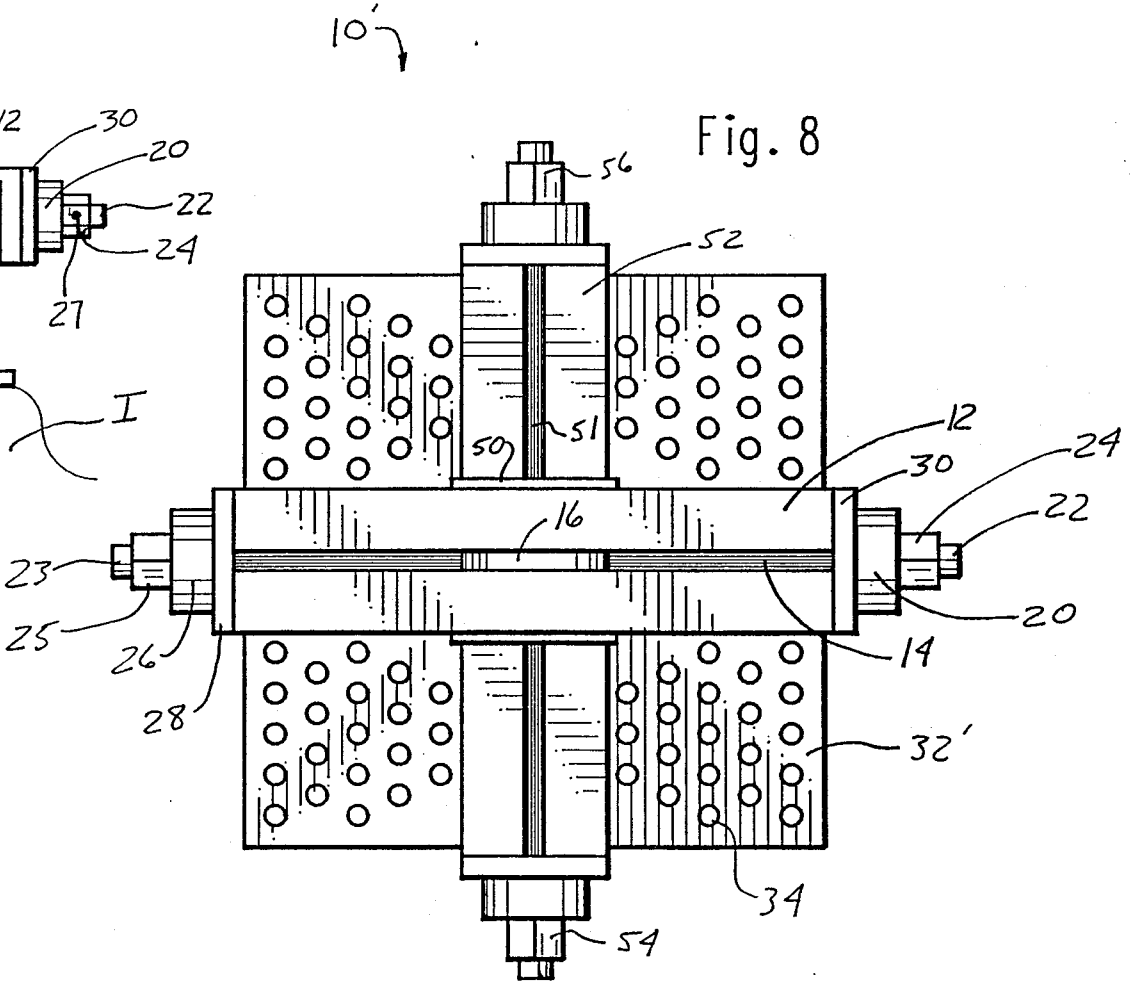
FIG. 8 is a top plan view of the engine tilting device of FIG. 7.

FIG. 8 illustrates a top plan view of the tilting device according to the second embodiment 10′. As may now be understood, the housing 52 is stationarily secured to the base plate 32′. The mounting plate 50 has a tab portion extending through the elongated slot 51 and secured to a roller bearing supported carriage mounted for reciprocal linear movement within the housing 52. Rotation of either of the driving heads 54 and 56 causes linear movement of the mounting plate 50 along the top surface of the housing 52, parallel with the direction of the slot 51. The lifting tab 16 is mounted for movement along the slot 14 in a manner described previously. The list provides a compound adjustment for the mounting tab 16 which allows inclination of an engine from side to side or from front to back, as required during installation or removal.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An engine tilting device for use on an engine having an intake manifold provided with a plurality of threaded holes for securing a carburetor, comprising:

a base;

a plurality of apertures formed through said base in a predetermined pattern to match bolt hole patterns of a variety of standard intake manifolds;

a first elongated housing secured on said base;

a first lead screw extending through said first housing;

bearings at opposite ends of said first housing mounting said lead screw for rotation with respect to said first housing;

driving heads at opposite ends of said first lead screw for engagement with a wrench to allow rotation of said first lead screw;

a first carriage including a lead nut in threaded engagement with said first lead screw;

a plurality of roller bearings mounting said first carriage for reciprocal linear movement in said first housing;

a first elongated slot formed through a top wall of said first housing parallel with said first lead screw;

a mounting plate connected through said first slot to said first carriage, said mounting plate mounted for reciprocal linear movement along a top exterior wall of said first housing in a first direction;

a second elongated housing centrally secured on said mounting plate, said second housing extending perpendicular to said first housing;

a second lead screw extending through said second housing, said second lead screw extending perpendicular to said first lead screw;

bearings at opposite ends of said second housing mounting said second lead screw for rotation with respect to said second housing;

driving heads at opposite ends of said second lead screw for engagement with a wrench to allow rotation of said second lead screw;

a second carriage including a lead nut in threaded engagement with said second lead screw;

a plurality of roller bearings mounting said second carriage for reciprocal linear movement in said second housing;

a second elongated slot formed through a top wall of said second housing parallel with said second lead screw;

and a lifting tab extending through said second slot and secured to said second carriage, said lifting tab mounted for reciprocal linear independent movement in said first direction and a second perpendicular direction.

* * * * *